US006744617B2

(12) United States Patent
Fujii

(10) Patent No.: US 6,744,617 B2
(45) Date of Patent: Jun. 1, 2004

(54) IONIZING APPARATUS AND DISCHARGE ELECTRODE BAR FOR THE SAME

(75) Inventor: Kentaro Fujii, Osaka (JP)

(73) Assignee: Keyence Corporation, Osaka (JP)

( * ) Notice: Subject to any disclaimer, the term of this patent is extended or adjusted under 35 U.S.C. 154(b) by 273 days.

(21) Appl. No.: 09/945,864

(22) Filed: Sep. 4, 2001

(65) Prior Publication Data

US 2002/0093779 A1 Jul. 18, 2002

(30) Foreign Application Priority Data

Jan. 18, 2001 (JP) ..... P2001-010237

(51) Int. Cl.[7] ..... H05F 3/00
(52) U.S. Cl. ..... 361/231; 361/230
(58) Field of Search ..... 361/231, 213, 361/230, 229, 225, 212

(56) References Cited

U.S. PATENT DOCUMENTS 3,624,448 A 11/1971 Saurenman et al. ..... 317/4
4,136,564 A * 1/1979 Suzuki et al. ..... 73/861.09
4,498,116 A 2/1985 Saurenman et al. ..... 361/231
4,734,580 A 3/1988 Rodrigo et al. ..... 361/231
4,974,115 A 11/1990 Breidegam et al. ..... 361/231
5,017,876 A 5/1991 Wright et al. ..... 374/464
5,550,703 A * 8/1996 Beyer et al. ..... 361/229

FOREIGN PATENT DOCUMENTS

JP 08-298196 11/1996

* cited by examiner

*Primary Examiner*—Lawrence Luk
(74) *Attorney, Agent, or Firm*—Kilyk & Bowersox, P.L.L.C.

(57) ABSTRACT

A discharge electrode bar 100 includes a case 101. In the case 101, an air unit 102 and discharge electrode assemblies 103 are disposed in its lower region, and a high voltage unit 104 and a control unit 105 including a power supply circuit, a display circuit and a CPU, for example, are disposed in its upper region. The case 101 consists of left and right divisional case sections which can be detached from each other.

20 Claims, 6 Drawing Sheets

IONIZING APPARATUS AND DISCHARGE ELECTRODE BAR FOR THE SAME

BACKGROUND OF THE INVENTION

1. Field of the Invention

The present invention relates to control of static electricity in the air, and more particularly to an ionizing apparatus and a discharge electrode bar for the same.

2. Description of the Related Art

Elimination of static electricity (diselectrification) is used for the control of the static electricity in the air, such as purification in a clean room, prevention of electrification of floating particles, etc. A number of ionizing apparatuses of a corona discharge type have been used for non-contact diselectrification.

FIGS. 6 and 7 show a discharge electrode bar included in a DC ionizing apparatus which is currently available. The discharge electrode bar 1 includes an elongated cylindrical case 2. This case 2 has a plurality of discharge electrodes 3 (FIG. 6) arranged in a mutually spaced relation in a longitudinal direction. The case 2 contains a high voltage power supply unit 4 and a control unit 5 which are positioned between the adjacent pairs of discharge electrodes 3, 3. Moreover, the case 2 of the discharge electrode bar 1 is divided into two sections, namely an upper divisional case section 7 and a lower divisional case section 8 (FIG. 7).

It is to be noted that the plurality of the discharge electrodes 3 include positive poles and negative poles which are identified in the drawing with reference numerals 3*a* and 3*b* respectively. A flexible tube 6 is arranged inside case 2 so as to supply air to areas surrounding the discharge electrodes 3.

In the discharge electrode bar 1 of the related art, a structure has been employed where the high voltage power supply unit 4 and the control unit 5 are positioned between the adjacent discharge electrodes 3, 3. Therefore, the discharge electrode bar in the related art has had a problem that a minimum design distance between the adjacent discharge electrodes 3, 3 has been restricted by the size of the high voltage power supply unit 4 or the control unit 5. This creates a problem in cases where the discharge electrode bar 1 is intended to be arranged near a work site; for example, the diselectrification effects may lack uniformity.

In order to assemble the discharge electrode bar 1, the high voltage power supply unit 4, or the control unit 5, must first be fixed to the lower divisional case section 8 which has a large depth dimension. Inserting the high voltage power supply unit 4 or the control unit 5 into the lower divisional case section 8 and fixing them had to be performed through a narrow opening 8*a* of the lower divisional case section 8. Accordingly, in many cases, the opening 8*a* of the lower divisional case section 8 must be widened forcibly to accommodate the above-mentioned components, which makes assembly difficult.

SUMMARY OF THE INVENTION

In view of the above, an object of the invention is to provide an ionizing apparatus and a discharge electrode bar for the same in which flexibility of setting the distance between the discharge electrodes of the discharge electrode bar can be enhanced.

A further object of the invention is to provide an ionizing apparatus and a discharge electrode bar for the same in which the ease of assembling the components of the discharge electrode bar can be improved.

Another object of the invention is to provide a discharge electrode bar which will disturb air currents of the atmosphere to a minimum degree.

The above-described technical problems can be solved by an ionizing apparatus comprising a discharge electrode bar which includes an elongated case, a plurality of discharge electrodes arranged in a mutually spaced relation in a longitudinal direction of the case, a high voltage power supply unit and a control unit. In the ionizing apparatus, the high voltage power supply and the control unit are arranged in a line in the longitudinal direction of the case in an upper region of the case where they do not interfere with the discharge electrodes.

According to another aspect of the invention, the above-described technical problems can be solved by a discharge electrode bar for an ionizing apparatus comprising: an elongated case, a high voltage power supply unit and a control unit which are arranged in a line in a longitudinal direction of the case in an upper region of the case, an elongated air unit disposed in a lower region of the case, a plurality of discharge electrodes detachably fitted to the air unit and arranged in a mutually spaced relation in a longitudinal direction of the air unit, and an independent air passage which is isolated from the atmosphere inside the case and adapted to discharge air supplied from an air source through areas surrounding the discharge electrodes. In the discharge electrode bar, a part of the independent air passage is formed of an air passage in the air unit, and the air supplied to the air passage in the air unit is discharged to the exterior from the areas surrounding the discharge electrodes.

In a preferred embodiment according to the invention, the aforesaid case has a base plate portion which substantially separates an interior of the case into an upper part and a lower part. Because the interior of the case is substantially divided into an upper space and a lower space by the base plate, and the high voltage power supply unit which generates heat is disposed in the upper space, even if protecting material or filling material in the case, for example, becomes gasified, the gas will be prevented from flowing into the lower space. Preferably, the high voltage power supply unit may be hermetically sealed inside an airtight box. The high voltage power supply unit may be covered with a silicone resin or epoxy resin as the protecting material, if used. The silicone resin or epoxy resin can be hermetically sealed in the airtight box together with the high voltage power supply unit.

Left and right divisional case sections constituting the case may preferably form an inverted U-shape when they have been assembled into one piece. This shape may restrain turbulence in the air current flowing in a lower area of the atmosphere around the discharge electrode bar.

Further, the air unit may be preferably provided with projections on its side walls, and the left and right divisional case sections may be preferably provided with grooves for receiving the projections of the air unit on their inner walls. In this manner, in a state where the left and right divisional case sections are separated, the air unit can be incorporated into one of the divisional case sections by engaging the projection of the air unit in the groove of the one divisional case section and then, the other divisional case section can be assembled to the one divisional case section to form one piece, enabling the left and right divisional case sections to provide a configuration in which the air unit is held between them. The projection may be in a form of a ridge extending in a longitudinal direction of the air unit. Alternatively, the projections or ridges may be provided on the left and right divisional case sections, and the grooves for receiving them may be provided in the air unit.

Other objects, operation and effects of the invention will be apparent from the following detailed description of an embodiment.

DETAILED DESCRIPTION OF THE PREFERRED EMBODIMENT

Embodiments according to the invention will now be described in greater detail by referring to the accompanying drawings.

Figure 1:
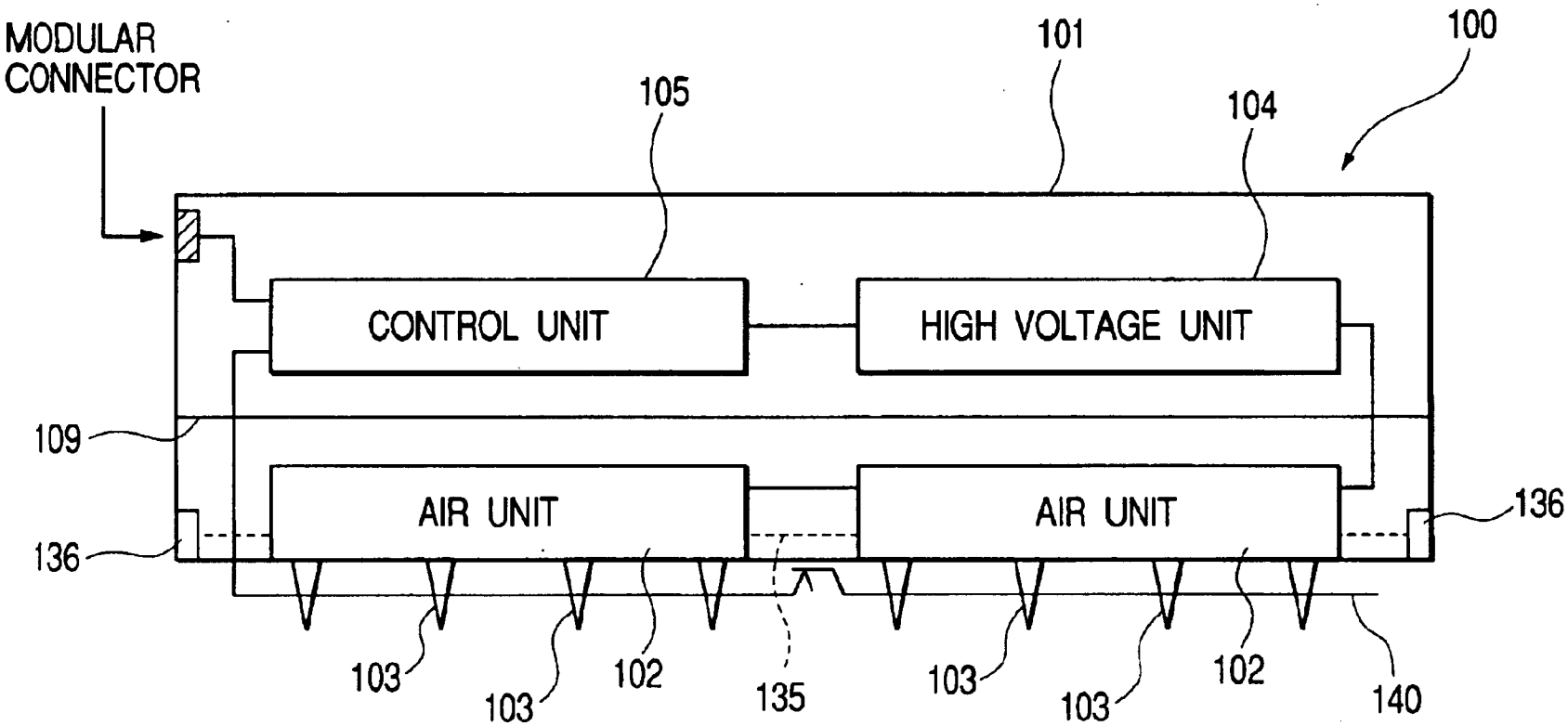
FIG. 1 is a view illustrating the structure of a discharge electrode bar of an embodiment according to the invention.

FIG. 1 is a view illustrating a discharge electrode bar in an ionizing apparatus in this embodiment. The discharge electrode bar 100 has a case 101. Inside the case 101, air units 102 and discharge electrode assemblies 103 are disposed in its lower region, while a high voltage unit 104 and a control unit 105 are disposed in its upper region. The control unit 105 includes a power supply circuit, display circuit and CPU for example. In the discharge electrode bar 100, since the high voltage unit 104 and the control unit 105, which constitute heat sources are positioned in the upper region, they do not interfere with the discharge electrode assemblies 103. Accordingly, since the control unit or other components are not placed between the adjacent discharge electrode assemblies 103, contrary to the structure in the related art, the distance between the adjacent discharge electrode assemblies 103, is not restricted and can be freely varied.

Figure 2:
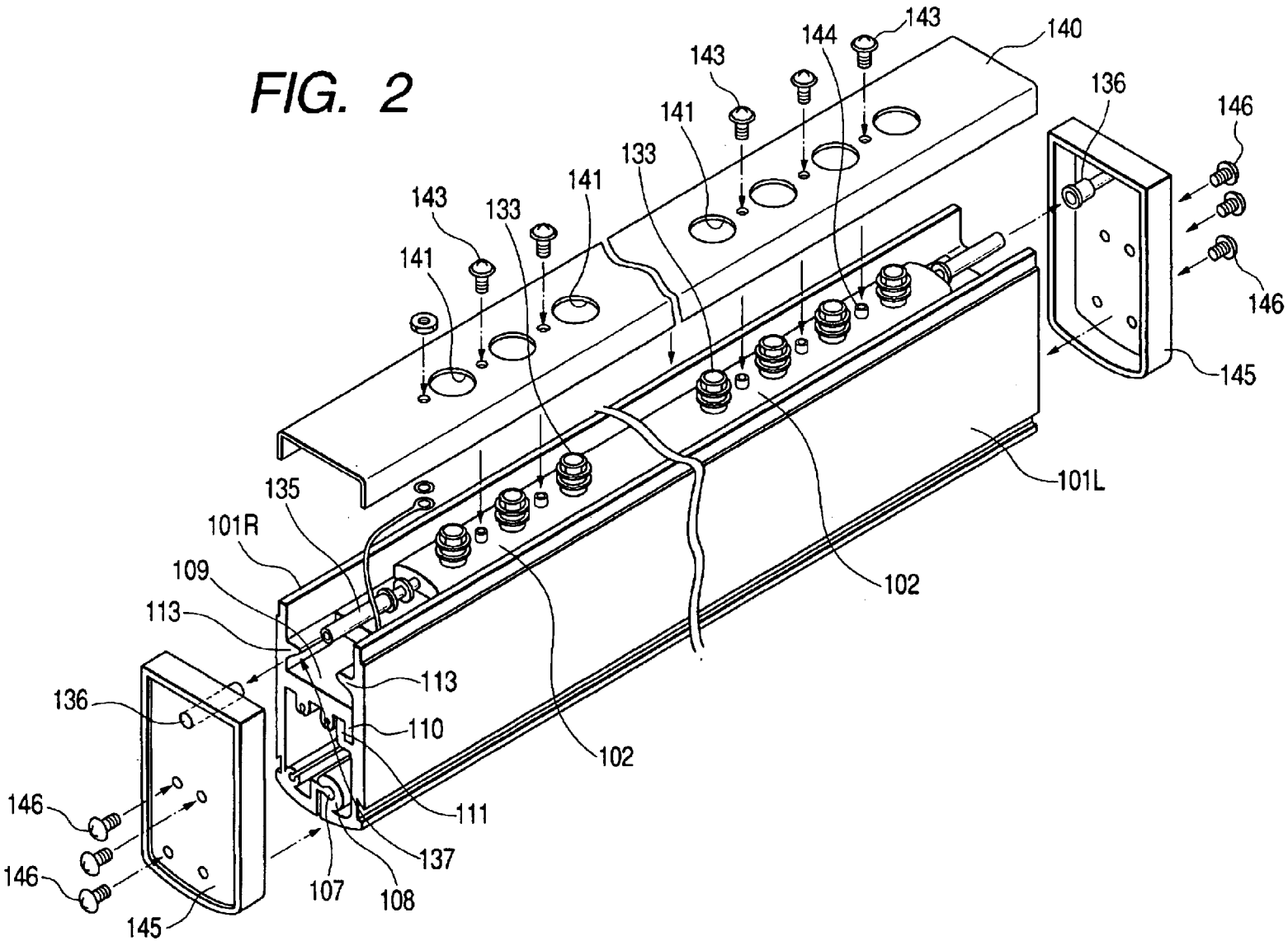
FIG. 2 is an exploded perspective view of an assembled discharge electrode bar of an embodiment.

As seen from FIG. 2, the case 101 is shown upside down from its normal position when the discharge electrode bar 100 is installed, because this figure depicts a stage in which the discharge electrode bar 100 is being assembled. The case 101 has an elongated form of inverted U-shape in cross section, whose upper end (lower end in the drawing) has a shape of relatively smooth curve in cross section. The case 101 has side walls extending in a substantially vertical direction from the upper end. The case 101 consists of a right divisional case section 101R and a left divisional case section 101L.

Both the left and the right divisional case sections 101L, 101R are extruded articles made of plastic material. The left and the right divisional case sections 101L, 101R, are slidably engageable with each other at their upper ends (lower ends in the drawing). Specifically, in the illustrated case 101, at the upper end (the lower end in the drawing) of the right divisional case section 101R, a laterally projecting enlarged head 107 is formed, which extends along the upper end edge of the right divisional case section 101R and along an entire length of the right divisional case section 101R. There is formed a groove 108 which has a contour complementary to a contour of the enlarged head 107, at the upper end (the lower end in the drawing) of the left divisional case section 101L. The groove 108 extends in a longitudinal direction along the upper end edge of the left divisional case section 101L. Both ends of the groove 108 are made open. The groove 108 can receive the enlarged head 107 from either of the ends. For example, by inserting the enlarged head 107 from one end of the groove 108, and allowing the left and the right divisional case sections 101L, 101R to slide with respect to each other, the left and the right divisional case sections 101L, 101R are connected to each other thereby forming an inverted U-shape in cross section which is open toward the lower ends (the upper ends in the drawing). Alternatively, the enlarged head may be provided in the left divisional case section 101L, and the groove may be provided in the right divisional case section 101R.

In the embodiment as shown in FIG. 2, a base plate portion 109 is integrally formed on a side wall of the right divisional case section 101R and extends laterally, that is, in a horizontal direction of the case. This base plate portion 109 extends along the entire length of the right divisional case section 101R (See also FIG. 3). A free end in a lateral direction exists, that is, a side edge of the base plate portion 109 is formed with a bent portion 110 which is bent upward (downward in FIGS. 2 and 3) at 90 degrees. Correspondingly, an L-shaped portion 111 is formed on a side wall of the left divisional case section 101L. This L-shaped portion 111 extends along the entire length of the left divisional case section 101L. In the alternative, the base plate portion 109 may be provided in the left divisional case section 101L, and the L-shaped portion 111 may be provided in the right divisional case section 101R.

When the case has been assembled by sliding the left and the right divisional case sections 101L, 101R with respect to each other, the bent portion 110 of the base plate portion 109 is received in a groove which is formed by the L-shaped portion 111 and opens downward (upward in FIG. 2). In this manner, the base plate portion 109 constitutes a partition wall which substantially separates the case 101 into an upper and a lower part.

The left and the right divisional case sections 101L, 101R are provided with a pair of ridges 113 in lower end portions (upper end portions in FIGS. 2 and 3) of the side walls, in other words, below (above in the drawings) the base plate portion 109. These ridges 113 extend along the entire length of the left and the right divisional case sections 101L, 101R.

Figure 4:
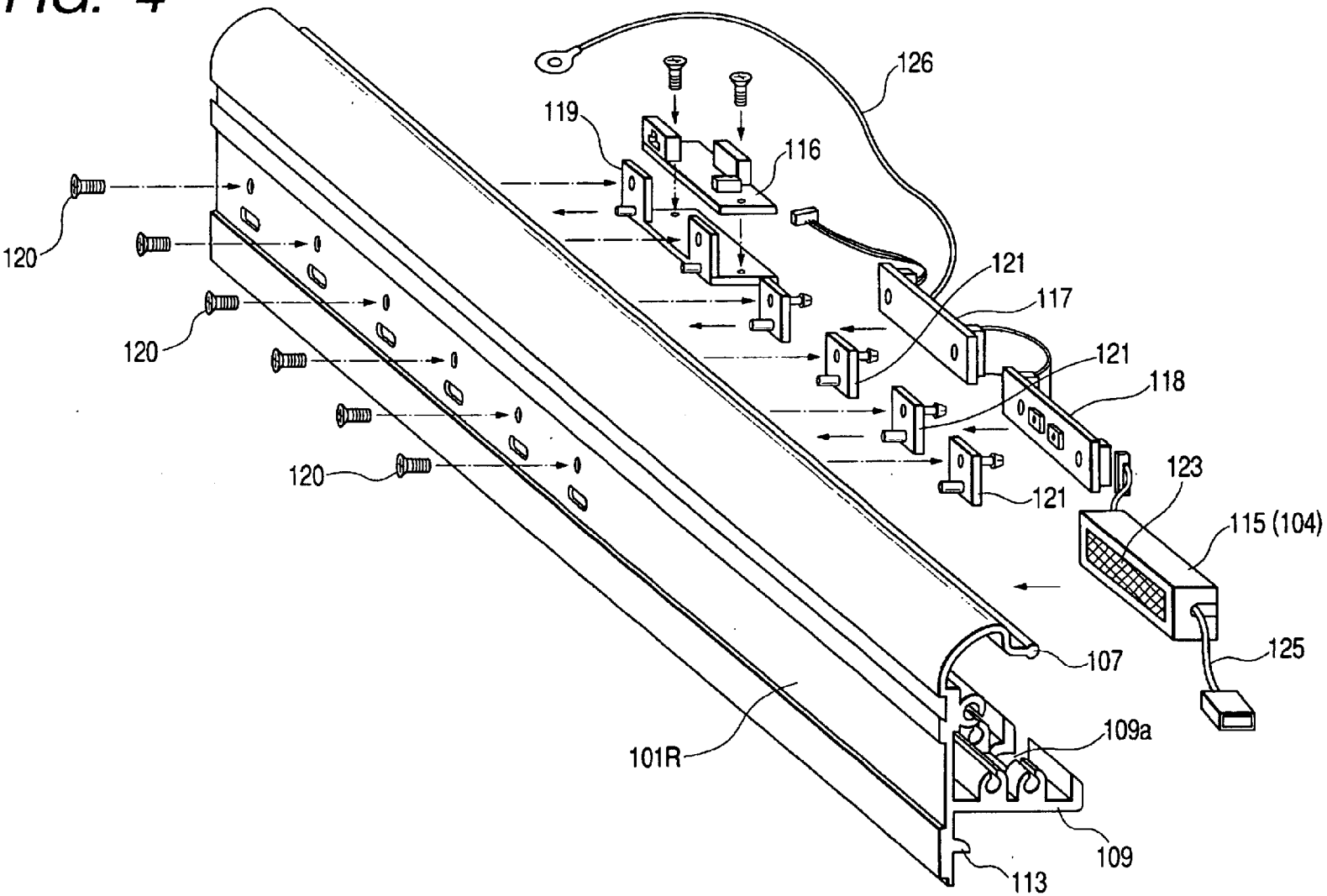
FIG. 4 is an exploded perspective view at a point where a power supply unit, etc. are being assembled to one of the divisional case sections of the case.

FIG. 4 is an exploded perspective view showing the various steps of assembling the high voltage unit 104 and the control unit 105 located in the upper part of the case 101. Reference numeral 115 in FIG. 4 represents a box having a rectangular shape in cross section for containing the high voltage unit. As described below, the high voltage unit 104 and protecting material, such as silicone, are hermetically contained in this box 115.

The above described control unit 105 includes a modular board 116, a power supply board 117, a CPU board 118 etc. The modular board 116 is fixed to the sidewall of the right divisional case section 101R by connection to a base plate 119 by means of screws 120. Locking pins 121 made of plastic material are fixed to the side wall of the right divisional case section 101R also by means of the screws 120. By inserting distal ends of the locking pins 121 in an anchor-like shape into holes in the power supply board 117 and the CPU board 118, the power supply board 117 and the CPU board 118 are fixed to the side wall of the right divisional case section 101R. The box 115 in which the high voltage unit 104 is contained is fixed to the side wall of the right divisional case section 101R using a double faced tape 123.

As will be understood from the foregoing description, the assembling work of the high voltage unit 104 and the control unit 105 is relatively easy, because the work can be conducted in an open space.

Figure 3:
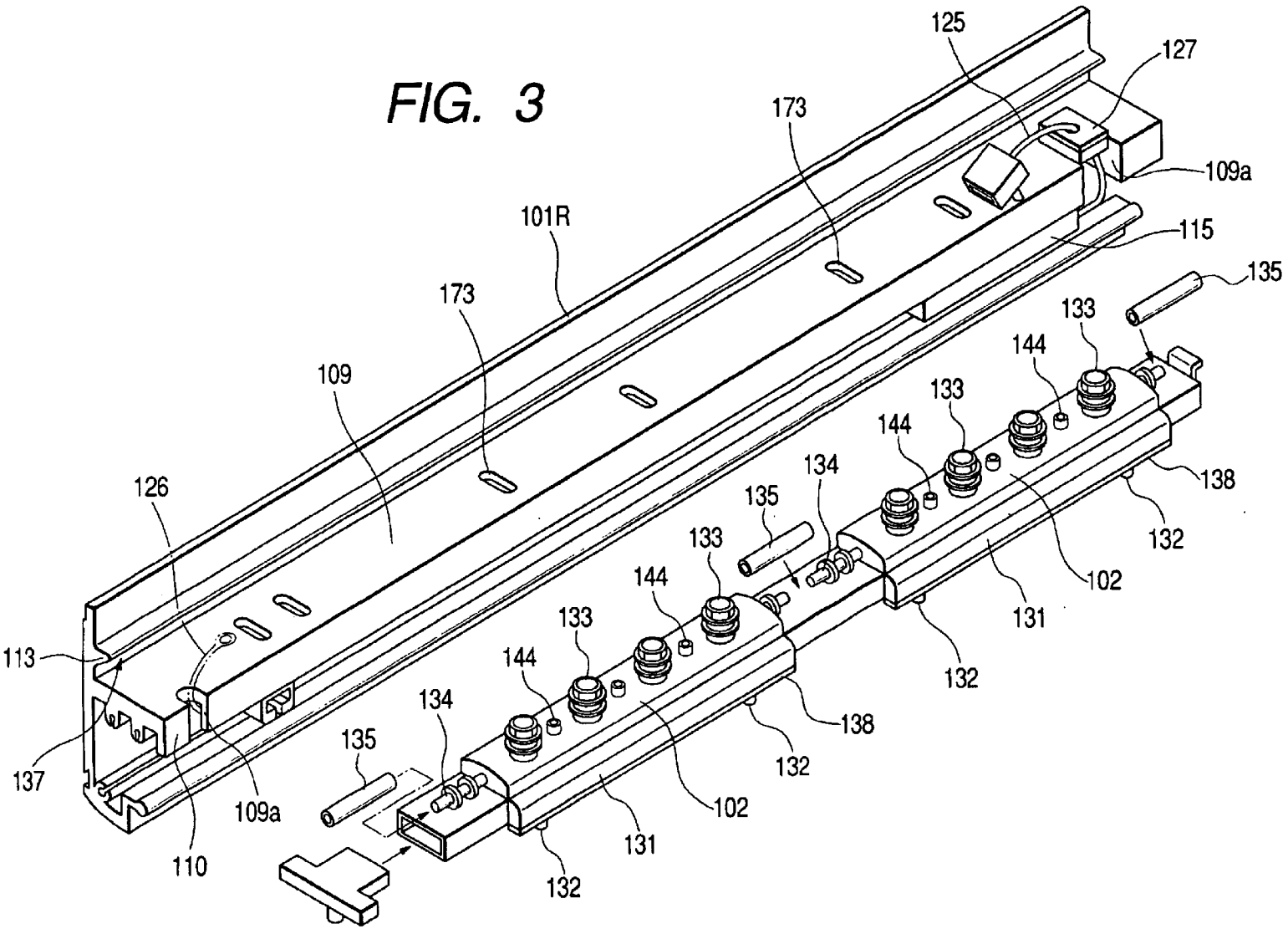
FIG. 3 is an exploded perspective view at a point where an air unit is being assembled to a divisional case section of a case.

The modular board 116, the power supply board 117, the CPU board 118 and the box 115 which have been fixed to the right divisional case section 101R in the above described manner are arranged in a line in a longitudinal direction of the right divisional case section 101R, in the upper region of the base plate portion 109 of the right divisional case section 101R. The base plate portion 109 of the right divisional case section 101R includes recesses 109*a* in longitudinal end portions thereof (FIG. 3). A cable 125 with a high voltage socket and a GND cable 126 are drawn out to the lower region of the base plate portion 109 through the recesses 109*a*. In situations where the recesses 109*a* are relatively large, preferably the recesses 109*a* may be substantially closed with packings 127 (FIG. 3), so that gas flow between the upper region and the lower region interposing the base plate portion 109 may be blocked to the utmost extent.

As shown in FIG. 2, the air unit 102 is disposed below (above in the drawing) the base plate portion 109. As shown in FIG. 3, the air unit 102 has flanges 131 which extend laterally and outwardly. These flanges 131 extend in a longitudinal direction of the air unit 102. A plurality of round bosses 132 extending upward (downward in the drawing) are provided on an upper wall (a lower wall in the drawing) of the air unit 102 with spacing in a longitudinal direction. A plurality of cylindrical portions 133 for engaging the discharge electrodes are provided on a lower wall (an upper wall in the drawing) of the air unit 102 with spacing in a longitudinal direction. Air tube joints 134 are provided on both end walls of the air unit 102. By inserting flexible tubes 135 into these joints 134, the adjacent air units 102 are connected to each other, and by connecting the flexible tubes 135 with air ports 136 (FIG. 2) supplied with air from an air source (not shown), fluid introduced into the air ports 136 can flow into the air units 102. The introduced air into the air unit 102 is distributed to an air passage 157 by way of an air passage 156. Then, the distributed air into the air passage 157 is discharged along an axis of an electrode 150 from several conduits 180 surrounding an electrode 150 and disposed in an cap 151. The air introduced into the air ports 136 (FIG. 2) flows through the air unit 102 and is discharged to the exterior from the discharge electrode assemblies 103.

In order to incorporate the air unit 102 into the case 101, while the flange 131 of the air unit 102 is inserted into a groove 137 (FIG. 3) which is formed by the base plate portion 109 and the ridge 113 of the right divisional case section 101R, for example, as shown in FIG. 3, the round bosses 132 of the air unit 102 are inserted into elongated holes 173 laterally extending in the base plate portion 109. By assembling the other left divisional case section 101L to the right divisional case section 101R in the manner previously described, the air unit 102 can be positioned with its flanges 131 on both sides received in the grooves 137. Movement of the air unit in a longitudinal direction will be substantially prevented by the engagement between the round bosses 132 and the elongated holes 173. For example, by attaching shock absorbing material such as rubber sheets 138 (FIG. 3) or the like to surfaces of the flanges 131, any play, i.e., a movement in a vertical direction of the air unit 102 after the air unit 102 has been incorporated may be avoided.

After the control unit 105 and the air unit 102 have been incorporated between the left and right divisional case sections 101L, 101R through the above described processes, the air unit 102 is covered with a GND plate 140 as shown in FIG. 2. In this manner, an elongated open space having an inverted U-shape in cross section formed of the left and right divisional case sections 101L, 101R is covered with the GND plate 140.

The GND plate 140 is provided with openings 141 at positions corresponding to the cylindrical portions 133 of the air unit 102. The diameter of the openings 141 is larger than the diameter of an outer contour of the cylindrical portions 133. The GND plate 140 is fixed to the air unit 102 by means of small screws 143 passing therethrough into receiving bosses 144 which are formed on a lower wall (an upwardly directed wall in the drawing) of the air unit 102.

The case 101 further includes a pair of end caps 145 (FIG. 2). Both openings at opposite ends of the left and right divisional case sections 101L, 101R provided with the GND plate 140 are closed by mounting the end caps 145. The end caps 145 are fixed to the left and right divisional case sections 101L, 101R by means of small screws 146.

Figure 5:
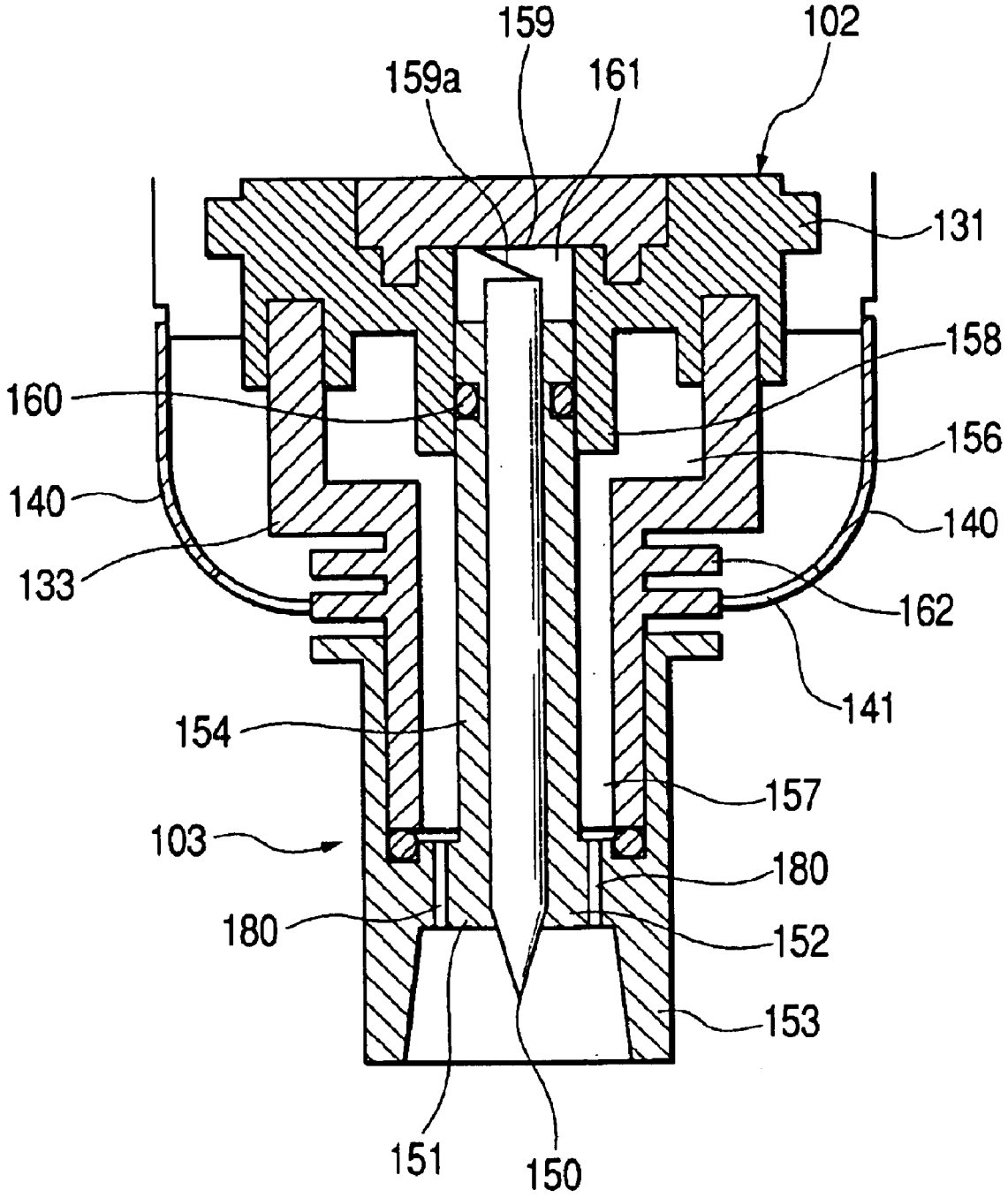
FIG. 5 is a sectional view illustrating the structure of a discharge electrode assembly assembled to the air unit in the embodiment.
Figure 6:
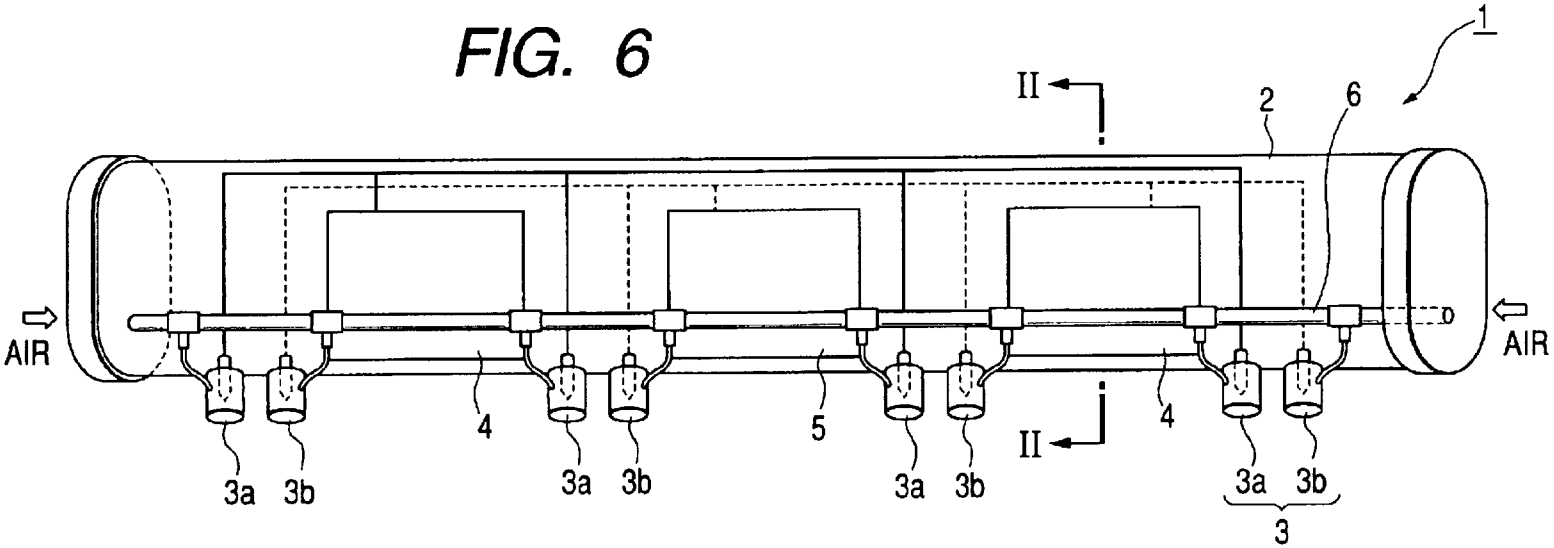
FIG. 6 is a view illustrating the structure of a discharge electrode bar in the related art.
Figure 7:
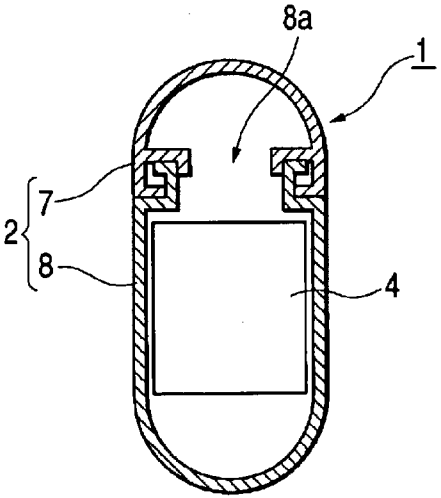
FIG. 7 is a sectional view taken along a line II—II of FIG. 6 illustrating the structure of the discharge electrode bar in the related art.

FIG. 5 illustrates the discharge electrode assembly 103 including an electrode 150 made of tungsten, for example, and a cap 151 for supporting the same. The cap 151 has a round base 152, an outer cylindrical portion 153, and a small diametered portion 154. The round base 152 supports the electrode 150 near its distal end. The outer cylindrical portion 153 extends upward and downward from a circumferential edge of the round base so as to surround the distal end of the electrode 150 and is adapted to be engaged with the outer peripheral face of the cylindrical portion 133 of the air unit 102. The small diametered portion 154 extends along the electrode 150 up to a position near a backward end of the electrode 150. By detachably engaging the outer cylindrical portion 153 of the discharge electrode assembly 103 with the cylindrical portion 133 of the air unit 102, the discharge electrode assembly 103 is fixed to the air unit 102. Between the small diametered portion 154 of the discharge electrode assembly 103 and the cylindrical portion 133 of the air unit 102, there is formed an air discharge passage 157 which communicates with an air passage 156 in the air unit 102. The air from the air source is discharged to the exterior from an air discharge port (not shown) adjacent to the electrode 150 of the discharge electrode assembly 103 through the air discharge passage 157 by way of the air unit 102 (the air passage 156).

The air unit 102 has a sleeve 158 which receives a backward end portion (an upward end portion in FIG. 5) of the small diametered portion 154 of the discharge electrode assembly 103. A high voltage mounting board 159 made of stainless steel is provided on a bottom face surrounded by the sleeve 158. The high voltage mounting board 159 is hermetically contained in a space (a space communicating with the sleeve 158) which is formed in the unit 102 along a longitudinal direction of the sleeve 158 so as not to be exposed to the exterior.

By incorporating the discharge electrode assembly 103 in the cylindrical portion 133 of the air unit 102, the small diametered portion 154 is inserted into the sleeve 158, and at the same time, the backward end face of the electrode 150 is brought into contact with a cut out portion 159*a* of the high voltage mounting board 159 to obtain an electric connection.

The small diametered portion 154 has an annular groove around the backward end portion thereof (the upper end portion in FIG. 5), and an O-ring 160 contained in the annular groove. After the small diametered portion 154 has entered in the sleeve 158, the O-ring 160 serves to hermetically close a space 161 in which the high voltage mounting board 159 and the backward end of the electrode 150 are positioned.

The cap 151 of the discharge electrode assembly 103 is preferably formed of resin material having a high Comparative Tracking Index ("CTI") value, for example, which is resistant to current leakage. A CTI value for the resin material (e.g., PBT, Liquid Crystal Polymer, polystyrene) of 400 or higher is preferred. (CTI is a standard measure of the voltage which causes tracking after 50 drops of 0.1 percent ammonium chloride solution have fallen on the identified material. The results of testing the minimal 3 mm thickness are considered representative of the material's performance in any thickness). Insulation performance with respect to current leakage (e.g., creeping discharge) can be assured with the cap 151. Outer peripheral faces of the cap 151 and the cylindrical portion 133 of the air unit 102 may be preferably provided with a single or a plurality of circumferential flanges 162 as shown, for instance, in FIG. 5, so as to prevent or minimize current leakage. The dimensions of opening 141 of the GND plate 140 are selected so as to provide an appropriate distance between the circumferential edge of the opening 141 and the outer peripheral edges of the circumferential flanges 162 of the cap 151, or the cylindrical portion 133 of the air unit 102, thereby preferably avoiding current leakage between these components. Because proper spacing between the identified components also prevents other electric discharge pathways, it is desirable to set this distance more than the distance necessary merely to prevent current leakage, based on the amount of electric voltage to be applied to the discharge electrode 150.

The air unit 102 is comprised of several parts. These parts, especially those parts comprising the air passage 156 may be preferably welded by using an ultrasonic welding method or the like, for example. By fixing the parts of the air unit 102 by welding, the insulating performance is improved, and the current leakage can be prevented from occurring along mated faces between the parts. Further, because the parts constituting the air unit 102 are preferably assembled to each other in tight contact, an independent air passage which is completely isolated from the atmosphere in case 101 can be provided, until the air introduced from the air source through the air ports 136 is discharged from the discharge electrode assembly 103.

It is not crucial whether or not the air is to be introduced from the air source through the air ports 136 and to be discharged from the discharge electrode assemblies 103. The electric discharge may be conducted while the air is discharged from the discharge electrode assemblies 103, or the discharge electrode assemblies 103 may be used in such a manner that the air is not discharged from the discharge electrode assemblies 103. In cases where the air is not discharged from the discharge electrode assemblies 103, since case 101 of the discharge electrode bar 100 having an inverted U-shape in cross section is relatively narrow in width, and the length in a direction perpendicular to the longitudinal direction of the side walls of the case 101 is relatively long, the air current flowing in the lower part of the atmosphere around the discharge electrode bar 100 can pass without turbulence, and velocity of diselectrification can be enhanced.

Provided that the inner air passage 156 is omitted from the discharge electrode bar 100, it is substantially sufficient to provide only a base including the sleeve 158 and the high voltage mounting board 159 provided in the bottom part surrounded by this sleeve 158, instead of the air unit 102. This high voltage mounting board 159 may be preferably surrounded by appropriate plastic molding material inside the case 101 so as not to be exposed to the exterior. This eliminates the necessity of covering the high voltage mounting board 159 with a silicone filler.

The power supplied to the above described discharge electrode bar 100 and the ionizing apparatus including the same may be either an AC current or DC current. Assembling of the discharge electrode bar 100 can be conducted easily, because case 101 of the discharge electrode bar 100 is composed of the left and the right divisional case sections 101L, 101R. In addition, because there is provided a base plate portion 109 substantially partitioning the interior of case 101 into the upper and the lower regions, the upper region can be substantially separated from the lower region.

What is claimed is:

1. An ionizing apparatus comprising a discharge electrode bar, said discharge electrode bar comprising:

an elongated case having an upper and a lower region, and a partition wall that substantially divides said case into said upper region and said lower region;

a plurality of discharge electrodes disposed in a mutually spaced relation in a longitudinal direction of said case in said lower region of said case;

a high voltage power supply; and a control unit, wherein said power supply unit and said control unit are disposed in a line in the longitudinal direction of said case in said upper region of said case.

2. The ionizing apparatus as claimed in claim 1, wherein said high voltage power supply unit and said control unit are disposed in a spaced relation from said discharge electrodes in a direction perpendicular to the longitudinal direction of said case.

3. The ionizing apparatus as claimed in claim 1, wherein said discharge electrode bar further comprises:

an independent air passage disposed in the lower region of said case, for discharging air supplied from an air source to areas adjacent to said discharge electrodes.

4. The ionizing apparatus as claimed in claim 3, wherein said high voltage power supply unit and said control unit are disposed in a spaced relation from said independent air passage in a direction perpendicular to the longitudinal direction of said case.

5. The ionizing apparatus as claimed in claim 3, wherein said independent air passage is isolated from an atmosphere in said case.

6. The ionizing apparatus as claimed in claim 3, wherein said independent air passage further comprises:

an air unit for discharging air supplied from the air source to the areas adjacent to said discharge electrodes; and a flexible tube connected to said air unit, for transmitting the air supplied from the air source to said air unit, wherein said discharge electrodes are detachably disposed on the air unit in a mutually spaced relation in the longitudinal direction of said case.

7. The ionizing apparatus as claimed in claim 1, wherein said high voltage power supply unit is hermetically sealed in an airtight box.

8. The ionizing apparatus as claimed in claim 1, wherein said elongated case further comprises:

a right divisional case section constituting one of the side walls of said elongated case; and a left divisional case section constituting the other of the side walls of said elongated case so that said case can be divided to the right and left.

9. The ionizing apparatus as claimed in claim 1, wherein said elongated case is an inverted U-shape.

10. A discharge electrode bar for an ionizing apparatus, said discharge bar comprising:

an elongated case having an upper and a lower region, and a partition wall that substantially divides said case unto said upper region and said lower region;

a plurality of discharge electrodes disposed in a mutually spaced relation in a longitudinal direction of said case in said lower region of said case;

a high voltage power supply; and a control unit, wherein said power supply unit and said control unit are disposed in a line in the longitudinal direction of said elongated case in said upper region of said elongated case.

11. The discharge electrode bar as claimed in claim 10, wherein said high voltage power supply unit and said control unit are disposed in a spaced relation from said discharge electrodes in a direction perpendicular to the longitudinal direction of said elongated case.

12. The discharge electrode bar as claimed in claim 10, further comprising:

an independent air passage disposed in said lower region of said elongated case, for discharging air supplied from an air source to areas adjacent to said discharge electrodes.

13. The discharge electrode bar as claimed in claim 12, wherein said high voltage power supply unit and said control unit are disposed in a spaced relation from said independent air passage in a direction perpendicular to the longitudinal direction of said elongated case.

14. The discharge electrode bar as claimed in claim 12, further comprising:

an elongated air unit disposed in the lower part of said elongated case and having an air passage forming a part of said independent air passage, wherein said discharge electrodes are detachably disposed on the air unit in a mutually spaced relation in the longitudinal direction of said air unit and the air supplied from the air source is discharged to areas adjacent to said discharge electrodes through the air passage of the air unit.

15. The discharge electrode bar as claimed in claim 10, wherein said high voltage power supply unit is hermetically sealed in an airtight box.

16. The discharge electrode bar as claimed in claim 10, wherein said elongated case includes a right divisional case section and a left divisional case section, which are divided to the right and left in the lateral direction of said elongated case.

17. The discharge electrode bar as claimed in claim 10, wherein said elongated case is an inverted U-shape.

18. The discharge electrode bar as claimed in claim 17, wherein said elongated case further comprises:

a GND plate for covering an opening of the elongated case opening downward, wherein said GND plate has openings larger than an outer contour of each of said discharge electrodes, so that creation of current leaks between an edge of the opening of the GND plate and each of said discharge electrodes can be prevented.

19. The ionizing apparatus as claimed in claim 6, wherein said partition wall supports said air unit.

20. The discharge electrode bar as claimed in claim 14, wherein said partition wall supports said elongated air unit.

* * * * *

UNITED STATES PATENT AND TRADEMARK OFFICE

CERTIFICATE OF CORRECTION

PATENT NO. : 6,744,617 B2
DATED : June 1, 2004
INVENTOR(S) : Fujii

It is certified that error appears in the above-identified patent and that said Letters Patent is hereby corrected as shown below:

Column 9,
Line 13, change "unto" to -- into --.

Signed and Sealed this

Twelfth Day of July, 2005

JON W. DUDAS
*Director of the United States Patent and Trademark Office*